US008920067B2

(12) United States Patent
Baumgartner et al.

(10) Patent No.: US 8,920,067 B2
(45) Date of Patent: Dec. 30, 2014

(54) CONCRETE DECORATIVE INLAY PROCESS

(71) Applicant: Single Eagle, Inc., Poway, CA (US)

(72) Inventors: Russell W. Baumgartner, Rancho San Diego, CA (US); Ricardo Vasquez, Jr., Escondido, CA (US); Otto W. Marx, Vista, CA (US)

(73) Assignee: Single Eagle, Inc., Poway, CA (US)

( * ) Notice: Subject to any disclaimer, the term of this patent is extended or adjusted under 35 U.S.C. 154(b) by 0 days.

(21) Appl. No.: 13/903,795

(22) Filed: May 28, 2013

(65) Prior Publication Data

US 2013/0315666 A1 Nov. 28, 2013

Related U.S. Application Data

(60) Provisional application No. 61/651,772, filed on May 25, 2012.

(51) Int. Cl.
*E01C 11/00* (2006.01)
*E01C 19/50* (2006.01)
*B44C 1/26* (2006.01)

(52) U.S. Cl.
CPC ..... *E01C 11/00* (2013.01); *E01C 19/508* (2013.01); *B44C 1/26* (2013.01)
USPC ..... 404/75; 404/17

(58) Field of Classification Search
CPC ..... E01C 11/00; E01C 19/508; B44C 1/26
USPC ..... 404/72, 75
See application file for complete search history.

(56) References Cited

U.S. PATENT DOCUMENTS

| | | | | | |
|---|---|---|---|---|---|
| 1,137,595 | A * | 4/1915 | Eyl | 264/247 |
| 3,515,779 | A * | 6/1970 | Jones | 264/41 |
| 4,254,077 | A * | 3/1981 | Fontana et al. | 264/225 |
| 5,047,187 | A * | 9/1991 | Banus | 264/71 |
| 5,243,905 | A * | 9/1993 | Webber | 101/128 |
| 6,033,146 | A * | 3/2000 | Shaw et al. | 404/20 |
| 7,322,772 | B2 * | 1/2008 | Shaw et al. | 404/75 |
| 7,749,345 | B2 * | 7/2010 | Wood | 149/37 |
| 2006/0159517 | A1 * | 7/2006 | Hagerman et al. | 404/71 |
| 2008/0206509 | A1 * | 8/2008 | Kent et al. | 428/67 |

* cited by examiner

*Primary Examiner* — Raymond W Addie
(74) *Attorney, Agent, or Firm* — Richard D. Clarke

(57) ABSTRACT

The present invention is directed to a Concrete Decorative Inlay Process where the concrete slab is initially poured with a recessed section constructed with a rough broom finish on the bottom. After curing a bonding agent is applied and an artistic form is located on the depressed area and additional concrete, possibly of different colors or textures to enhance the design, is poured into the design cavity and a variety of decorative elements are inlayed this area. After the design area has cured the artistic form is removed and the recessed area is then filled in, possibly with still a different color or texture of concrete to finish the project. This allows ample time to work in close proximity to the design area and the ability of using different elements to enhance the design.

10 Claims, 16 Drawing Sheets

CONCRETE DECORATIVE INLAY PROCESS

FIELD OF THE INVENTION

This application provides a unique process of inlaying decorative elements into the finished surface of concrete during the initial construction processes.

BACKGROUND OF THE INVENTION

There is a growing need for quickly and easily inlaying decorative materials within artistic designs in concrete during the construction process. Too often when these designs are attempted they are rough, the edges where the materials meet are uneven, the decorative materials tend to release and come out during climate changes and the complete designs do not have a professional finished appearance that the artist has desired. The artists that create the designs are not normally capable of getting out on the wet concrete to actually create the finished product and will rely upon the concrete finishers to duplicate the artistic rendering they had created. This generally ends up being not quite what the artist had in mind. Additionally the drying time of concrete is relatively short which often limits the time to inlay the decorative elements while completing the surface finishing processes.

Numerous innovations for providing decorative patterns on a variety of surfaces have been provided in the prior art that are described as follows. Even though these innovations may be suitable for the specific individual purposes to which they address, they differ from the present design as hereinafter contrasted. The following is a summary of those prior art patents most relevant to this application at hand, as well as a description outlining the difference between the features of the Concrete Decorative Inlay Process and the prior art.

U.S. Pat. No. 7,493,732 of Robin Brailsford et al. describes a mosaic concrete product, methods of creating the same, and methods of fabricating a module for use in creating the mosaic are provided. The methods of installing the mosaic upon an uncured concrete surface utilize the module. The module may be fabricated by mapping out tile in a design corresponding to the mosaic adhering the tile to a template utilizing an adhesive, the tile being positioned thereon corresponding to the design; and allowing the adhesive to set. The module may define upper and lower surfaces; the upper surface including the tile adhered thereto. The methods of installing the mosaic comprises: positioning the module upon the uncured concrete surface; embedding the tile into the concrete surface; massaging the tile into the concrete surface to interpose a quantity of cement/fines paste between the adjacent tiles; and finishing the concrete surface.

This patent describes a process of adhering mosaic tiles to a template of paper or a mesh utilizing an adhesive. The paper is to be placed on top of the wet concrete and the mesh to be imbedded into the concrete. This provides a limited time to work on the project. When using the paper the concrete has to set enough to hold the mosaic tiles and the adhesive has to release from the tiles in time to finish the concrete around the design. Depending upon the ambient temperature this can create a very limited working time. When the tiles on the mesh are imbedded in the wet concrete slab there will not be any concrete around the design that will enhance the design with color or texture. This process does not depict the unique features of the Concrete Decorative Inlay Process where design patterns are inlayed in concrete slabs.

U.S. Pat. No. 4,217,740 of Philip N. Assanti a variable mosaic pattern formed from interfitting blocks formed into standard shape is disclosed groups with curved or serpentine shapes. Interchangeability of the groups of the standard shapes permits easy installation, and production machinery presently available permits low cost manufacturing of the interchangeable components, which can be made of a suitable plastic molded from suitably shaped molds or stamped out on presses, cut from slabs of stone, or formed by other suitable means. The interchangeable components can be assembled indefinitely in any direction in an ever-changing mosaic pattern creating a random decorative effect.

This patent describes a variable mosaic pattern formed from interfitting blocks formed into standard shape and does not depict the unique features of the Concrete Decorative Inlay Process where design patterns are inlayed in concrete slabs.

U.S. Pat. No. 5,398,458 of Lars E. Henriksen describes an invention that generally relates to a process of and apparatus for manufacturing tile mosaics from at least two stone slabs, such as marble or granite slabs. The process comprises the steps of: a) cutting each of the two slabs into a matrix of pieces while maintaining the original orientation of the pieces, b) classifying the pieces of each matrix into two or more sets of pieces, c) intermixing a first set of pieces of one slab with a second set of pieces of another slab while maintaining the original orientation of the pieces, thereby forming the mosaic. The cutting apparatus comprises: a) a platen having a resilient layer for supporting the slab, b) a gantry table saw having a plurality of blades and a rotatable table for supporting the platen, and c) a hold-down rack for securing the slab and platen during cutting. At least two grippers are used to intermix at least one set of pieces from one slab with at least one set of pieces from a second slab to form the mosaic. By mixing the color shades and grain patterns of several different stone slabs, a mosaic having a handset look is achieved. Adjacent rows of the newly formed mosaic matrix may be offset to further enhance the handcrafted appearance of the mosaic.

This patent describes an invention that generally relates to an apparatus for manufacturing tile mosaics from at least two stone slabs, such as marble or granite slabs and does not depict the unique features of the Concrete Decorative Inlay Process where design patterns are inlayed in concrete slabs.

U.S. Pat. No. 5,470,623 of Jacques Lucas tells of a device making it possible to install tiles or any other decorative design in the form of a panel, particularly on walls or floors, wherein these decorative designs are laid down and adhere by adhesive pre-bonding on a mesh consisting of a trellis of filaments, the said panels are formed of two parts, an external polygon consisting of mosaics arranged in rigorously defined positions which determine the manner in which the panels fit together, and a random arrangement inside the said polygon or frame with a density of mosaics or stones such that they do not touch and do not form any alignment, the juxtaposition of the said panels formed in this way provides a final appearance devoid of connection joint lines.

This patent tells of a device making it possible to install tiles or any other decorative design in the form of a panel. This patent is very similar to that of U.S. Pat. No. 7,493,732 of Robin Brailsford et al, but does not provide the extended working time or the benefit of accenting colors or textures around the central design area.

U.S. Pat. No. 6,033,146 of Lee Shaw et al, tells of a surface seeded exposed particulate concrete called Glass Chip Lithocrete being method of use includes use of small particulates, the particulates not necessarily chemically inert in the concrete mixture. The particulates are broadcast over the tipper surface of the concrete, and mixed into the cement paste derived from the concrete matrix by floats and finished by hand sponging. A surface retarder and vapor barrier are applied, and washing and curing operations follow. The present invention adds a chemical treatment of hydrolyzed alkali silica solution, preferably lithium quartz, penetrating the upper surface of the concrete mixture with minerals and silicates within the concrete mix. The resultant exposed particulate concrete has extreme flatness and high wear resistance suitable for high-traffic flooring applications, aesthetics resembling terrazzo or ceramic tile at a fraction of the price, and the strength and resistance to corrosion expected of concrete surfaces.

This patent tells of a surface seeded exposed particulate concrete called Glass Chip Lithocrete but does not depict the unique features of the Concrete Decorative Inlay Process where design patterns are inlayed in concrete slabs.

None of these previous efforts, however, provides the benefits attendant with the Concrete Decorative Inlay Process. The present design achieves its intended purposes, objects and advantages over the prior art processes through a new, useful and unobvious combination of method steps and component elements by employing readily available materials.

In this respect, before explaining at least one embodiment of the Concrete Decorative Inlay Process in detail it is to be understood that the design is not limited in its application to the details of construction and to the arrangement, of the components set forth in the following description or illustrated in the drawings. The Concrete Decorative Inlay Process is capable of other embodiments and of being practiced and carried out in various ways. In addition, it is to be understood that the phraseology and terminology employed herein are for the purpose of description and should not be regarded as limiting. As such, those skilled in the art will appreciate that the conception, upon which this disclosure is based, may readily be utilized as a basis for designing of other structures, methods and systems for carrying out the several purposes of the present design. It is important, therefore, that the claims be regarded as including such equivalent construction insofar as they do not depart from the spirit and scope of the present application.

SUMMARY OF THE INVENTION

The principal advantage of the Concrete Decorative Inlay Process is that the design area can easily be worked on separately after the complete concrete slab has partially cured.

Another advantage of the Concrete Decorative Inlay Process is that a decorative recessed area around the central design can be filled with a different colored or texture to enhance the central design feature.

Another advantage of the Concrete Decorative Inlay Process is that the design template can be cut by the artist at a separate location.

Another advantage of the Concrete Decorative Inlay Process is that there is not the limited time required to create the design as there is in other design projects.

These together with other advantages of the Concrete Decorative Inlay Process along with the various features of novelty, which characterize the design, are pointed out with particularity in the claims annexed to and forming a part of this disclosure.

The initial preparation for the preferred embodiment of the Concrete Decorative Inlay Process is to compact the substrate to 90-95% compaction and form the outer perimeter area and install reinforcement wire mesh or rebar as required. Form the recessed design area, and install the concrete to the form height, with the recessed design area having a heavy broom finish. Allow the perimeter area to cure enough to be walked on allowing the workers to work closely to the design areas.

Install foam template or compressed board as per Artist and Architect's rendering and coat the broom finish on the recessed design area with a bonding agent. Place concrete within the foam template or compressed board design with a plus or minus 2 inch to 4 inch special concrete mix with a ⅜ inch or 1 inch mix and added in shrinkage reducer. A wide variety of design elements can easily be inlayed into the surface of the concrete to create a tessera finish such as, vitreous glass tile, aggregate rock, ceramic tile, ammonite fossils, glass baubles, and tumbled broken glass. Tamp and float the materials to required elevation and work cementations materials to ensure monolithic adhesion and apply the surface retarder as required.

When the surface has reached a reasonable cure then wash surface to remove cementations exposure over the design elements, a soft scrubber may be required. Continue power washing as necessary to the desired aesthetics and uniformity and remove the mold. Protect the tessera inlay and coat the remaining recessed area having a heavy broom finish with a bonding agent. Pour concrete in the depressed area around the raised design having the tessera inlay. This concrete may have a different color or surface texture to enhance the design features. Apply sealers when concrete has amply cured.

The preparation for the alternate embodiment of the Concrete Decorative Inlay Process will be to make designer templates of the outer contours of the desired design out of wood, composition or fiberglass approximately ½" thick. The edges of these templates may be squared or have a beveled edge to facilitate in the removal process. Prepare sub-grade to a 90%-95% compaction and form the outer perimeter area installing reinforcement wire mesh or rebar as required. Place minimum of 2" sand in form work to ensure ample bleeding once concrete has been placed and install form members and reinforcement set to desired depth, depending on thickness of concrete being placed.

Install concrete within the formed area and screed, tamp and float in the conventional manner. Seed aggregate into wet concrete if aggregate finish is required. Optional finishes can be acid etch or acid stains, sand finish, hard trowel, stamped textures or colored concrete. All may be used to enhance and compliment the architectural or artist's design.

While the concrete is still wet settle the designer templates into the wet concrete in the desired location. Finish surface elevation around the designer template tamping and floating cementatious materials in and around template insuring ample consolidation embedding aggregate uniformly into the fines and cement paste. Apply retarder by working with soft broom and install cure blanket to insure slowing curing procedure.

Once concrete has cured, wash slab and remove designer templates. Using a thin set or grout mixture, place inset tessera materials such as aggregate rock, ceramic tile, ammonite fossils, Glass bobbles or tumbled broken glass into desired location. Tamp and float tessera surface into position again to insure all particles fully embedded. The thin set or grout material may also be colored to enhance the Tessera design features. Apply retarder. Wash off concrete films to desire exposure. Once fully cured apply sealers and densifying agents.

Wet Set

The preparation for the second alternate embodiment of the Concrete Decorative Inlay Process will be to make flexible designer templates of a material like Mylar or Plexiglas and select all materials to be placed in artist's reproduction stencil. Place a minimum of 2" of sand to ensure ample bleeding once concrete has been placed and install form members and reinforcement, set to desired depth depending on thickness of concrete being placed.

Install concrete within the formed area and screed, tamp and float in the conventional manner. Seed aggregate into wet cement if aggregate finish is required or use an acid etch, acid stains, sand finish, hard trowel, stamped textures or colored concrete. All may be used to enhance and compliment the architectural or artist's design.

Once surface is satisfactorily floated and the concrete has achieved a partial cure, lay out stencils in the desired location. Using outline within the stencil, begin inlaying the desired tessera material in place and tamp to the level of the template. Remove stencil and begin tamping the surface of the concrete to proper elevation. Floating in circular motion will work the concrete paste and fines into voids creating a monolithic bond. Apply retarder. Wash off concrete films to desire exposure. Once fully cured apply sealers and densifying agents.

The foregoing has outlined rather broadly the more pertinent and important features of the present Concrete Decorative Inlay Process in order that the detailed description of the application that follows may be better understood so that the present contribution to the art may be more fully appreciated. Additional features of the design will be described hereinafter which form the subject of the claims of this disclosure. It should be appreciated by those skilled in the art that the conception and the disclosed specific embodiment may be readily utilized as a basis for modifying or designing other structures and methods for carrying out the same purposes of the present design. It should also be realized by those skilled in the art that such equivalent constructions and methods do not depart from the spirit and scope of this application as set forth in the appended claims.

BRIEF DESCRIPTION OF THE DRAWINGS

The accompanying drawings, which are incorporated in and form a part of this specification, illustrate embodiments of the Concrete Decorative Inlay Process and together with the description, serve to explain the principles of this application.

For a fuller understanding of the nature and advantages of the Concrete Decorative Inlay Process, reference should be had to the following detailed description taken in conjunction with the accompanying drawings which are incorporated in and form a part of this specification, illustrate embodiments of the design and together with the description, serve to explain the principles of this application.

DETAILED DESCRIPTION OF THE EMBODIMENTS

Figure 1:
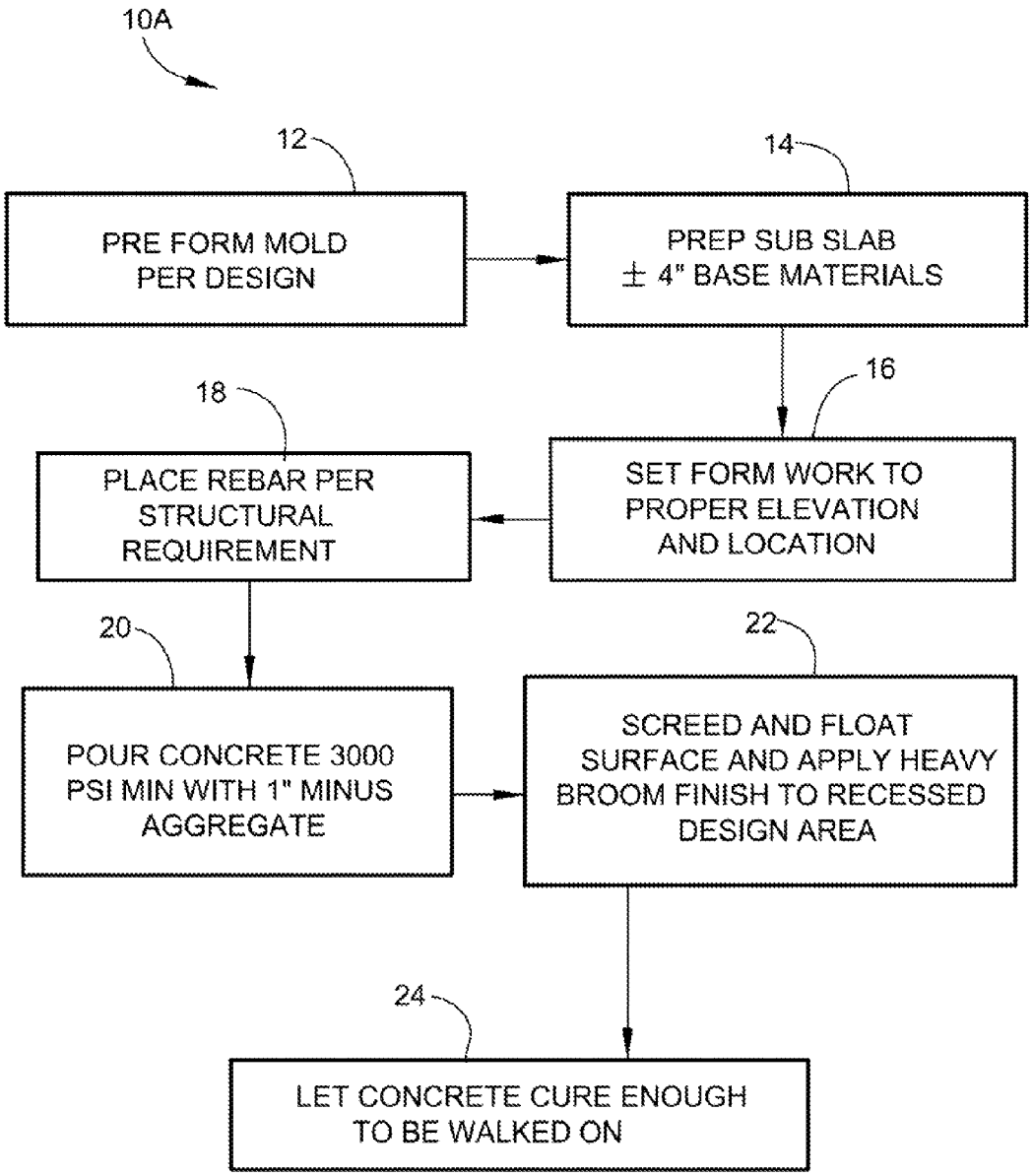
FIG. 1 depicts a block diagram of the initial steps involved in the preferred embodiment of the Concrete Decorative Inlay Process.

Referring now to the drawings, wherein similar parts of the Concrete Decorative Inlay Processes 10A, 10B and 10C are identified by like reference numerals, there is seen in FIG. 1 a block diagram that depicts the initial steps involved in the preferred embodiment of the Concrete Decorative Inlay Process 10A with 12 indicating the preparation of the pre-form mold per artistic design and 14 indicating the preparation of the sub slab base material. The setting of the form work is shown in 16 and the placement of the rebar in 18 with the pouring of the concrete in 20. Block 22 depicts the screeding and floating the concrete surfaces with a heavy broom finish in the recessed design area and letting the concrete cure enough to be walked on indicated in 24.

Figure 2:
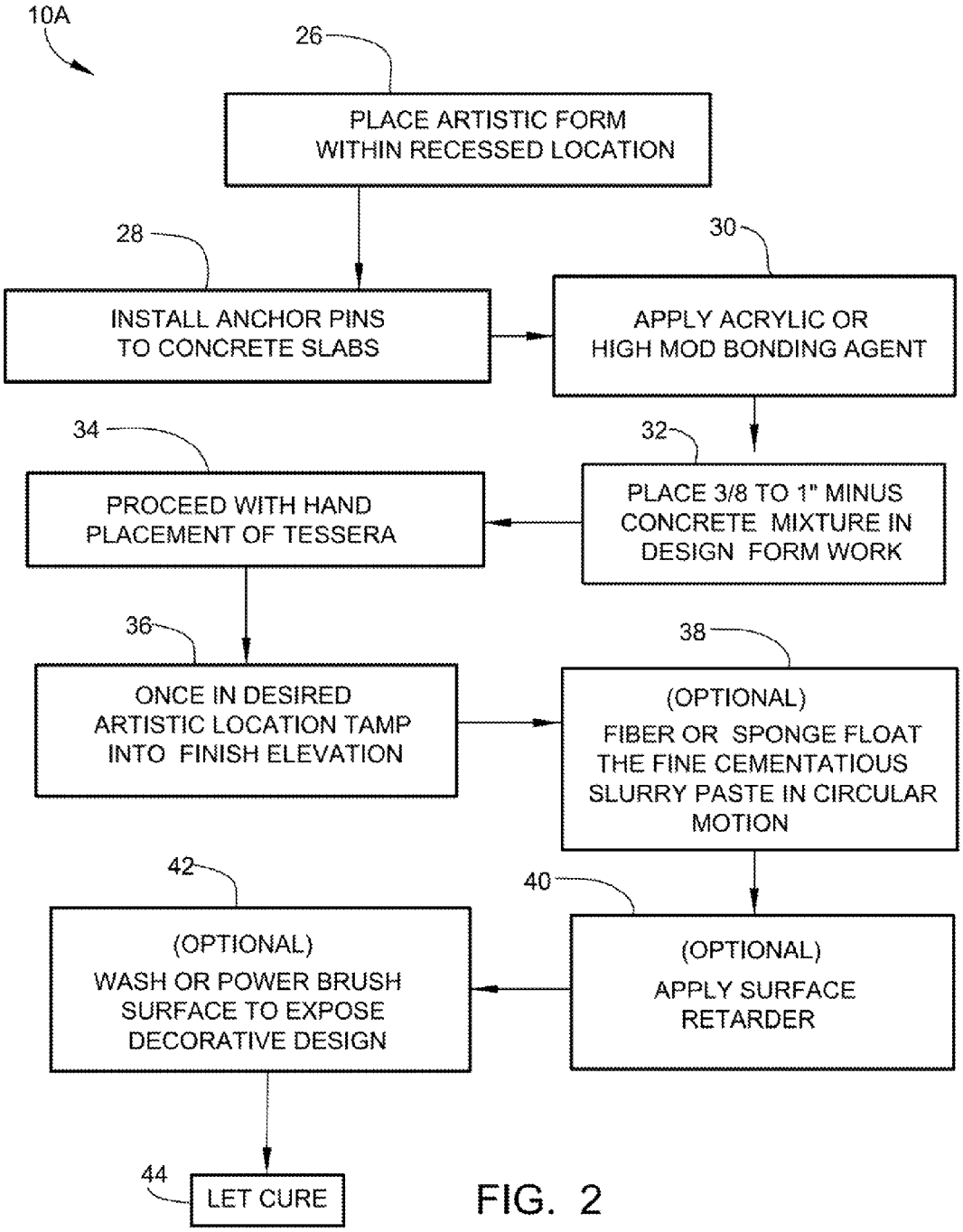
FIG. 2 depicts a second block diagram of the additional steps involved in the preferred embodiment of the Concrete Decorative Inlay Process.

FIG. 2 depicts a second block diagram of the additional steps involved in the preferred embodiment of the Concrete Decorative Inlay Process where numeral 26 indicates the placement of the artistic form within recessed location and the installation of the anchor pins into the concrete slab designated in block 28 with bonding agent shown in block 30. Numeral 32 indicates the placement of the concrete within the artistic design of the mold form work. The inset of the tessera design material depicted in block 34 and the tamping in the final finished location shown in block 36 with the fiber or sponge floating of the fine cementations slurry paste in a circular motion indicated in 38. Apply the surface retarder shown in 40 and wash or power brush the surface to expose decorative design shown in 42 along with letting cure in block 44. Steps 38 through 42 are optional, in most cases slurry in will occur in step 66 below (see FIG. 4 below).

Figure 3:
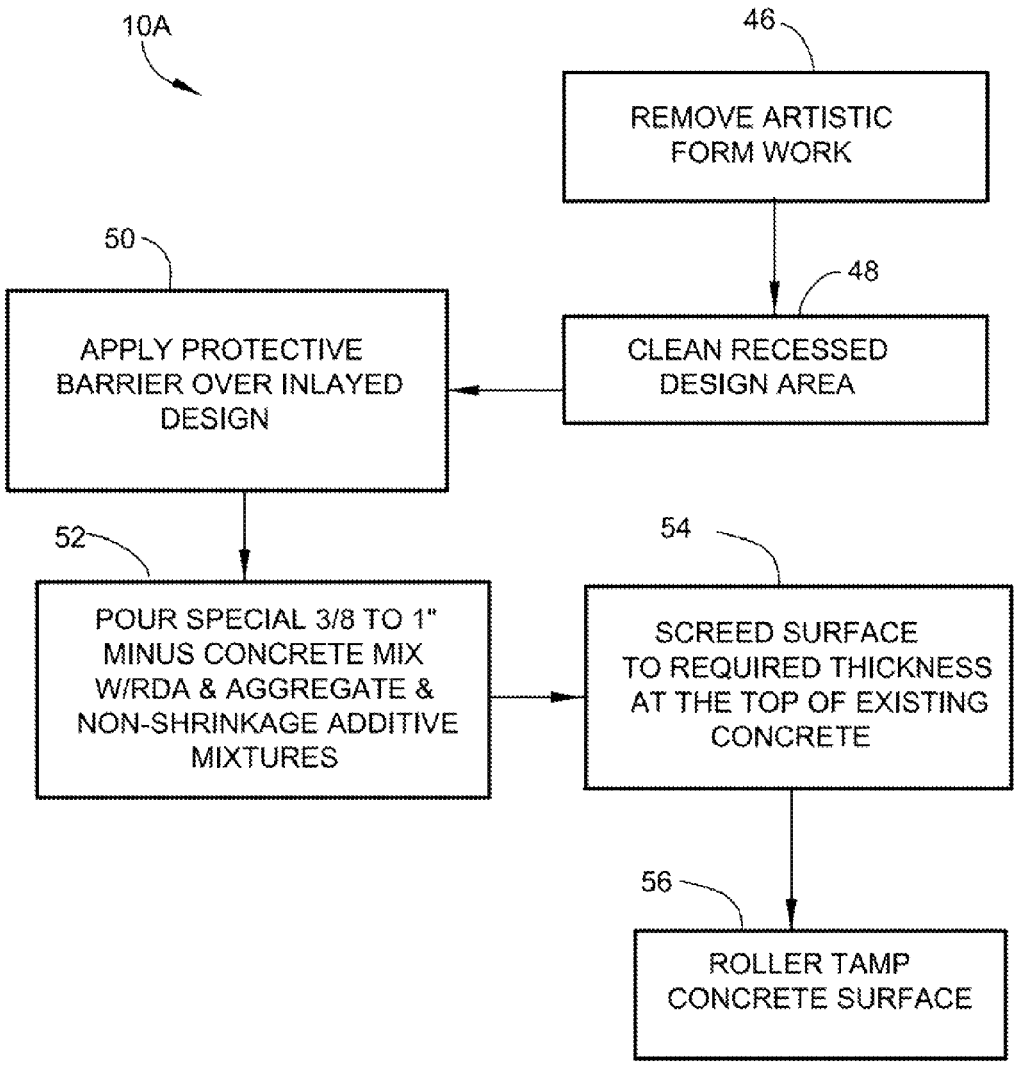
FIG. 3 depicts a third block diagram of the additional steps involved in the preferred embodiment of the Concrete Decorative Inlay Process.

FIG. 3 depicts a third block diagram depicting additional steps involved in the preferred embodiment of the Concrete Decorative Inlay Process after curing shown in block 42. When the concrete has cured enough to walk on, remove the artistic form work indicated in 46 and clean the recessed area in 48 then apply a protective barrier over the inlayed design indicated in block 50. Pour special ⅜ or 1 inch concrete mix W/RDA and aggregate with non-shrinkage additive mixtures depicted in 52 around the artistic design in the recessed area and screed the surface to the required thickness at the top of the existing concrete shown in 54. Roll tamp the concrete surface described in 56 and once the bleeding is complete fiber or magnesium float the surface removing any and all lines indicated in 60. Spread a layer of decorative aggregate over the designated surface shown in block 62 and again float with a fiber or magnesium float to insure a maximum embedment of the material depicted in 64.

Figure 4:
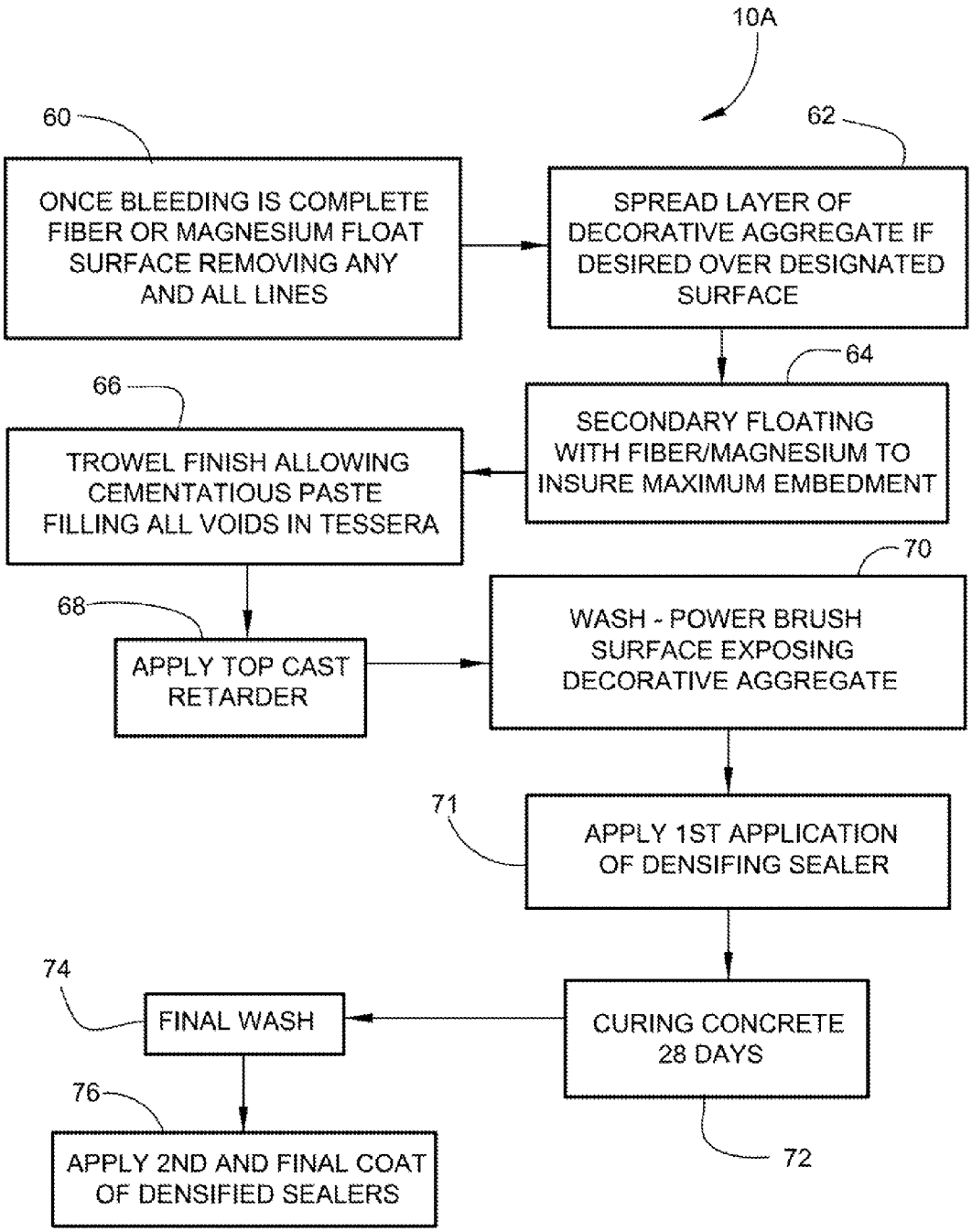
FIG. 4 depicts a fourth block diagram of the additional steps involved in the preferred embodiment of the Concrete Decorative Inlay Process.

FIG. 4 depicts a forth block diagram of the additional steps involved in the preferred embodiment of the Concrete Decorative Inlay Process where block 60 describes where once bleeding is complete fiber or magnesium float the surface removing any and all lines then spread a layer of decorative aggregate over designated surfaces shown in block 62. Block 64 describes the secondary floating with a fiber or magnesium float to insure maximum embedment and 66 indicates trowel finishing allowing the cementations paste to fill all the voids and tessera while 68 describes the application of a top coat retarder. Washing or power brushing the surface to expose the decorative aggregate is indicated in block 70, followed by a first application of a cure and densifying sealer 71, then with a curing time of 28 days in 72 and final wash in block 74, along with a second and final coat application the cure and densifying sealers in 76.

Figure 5:
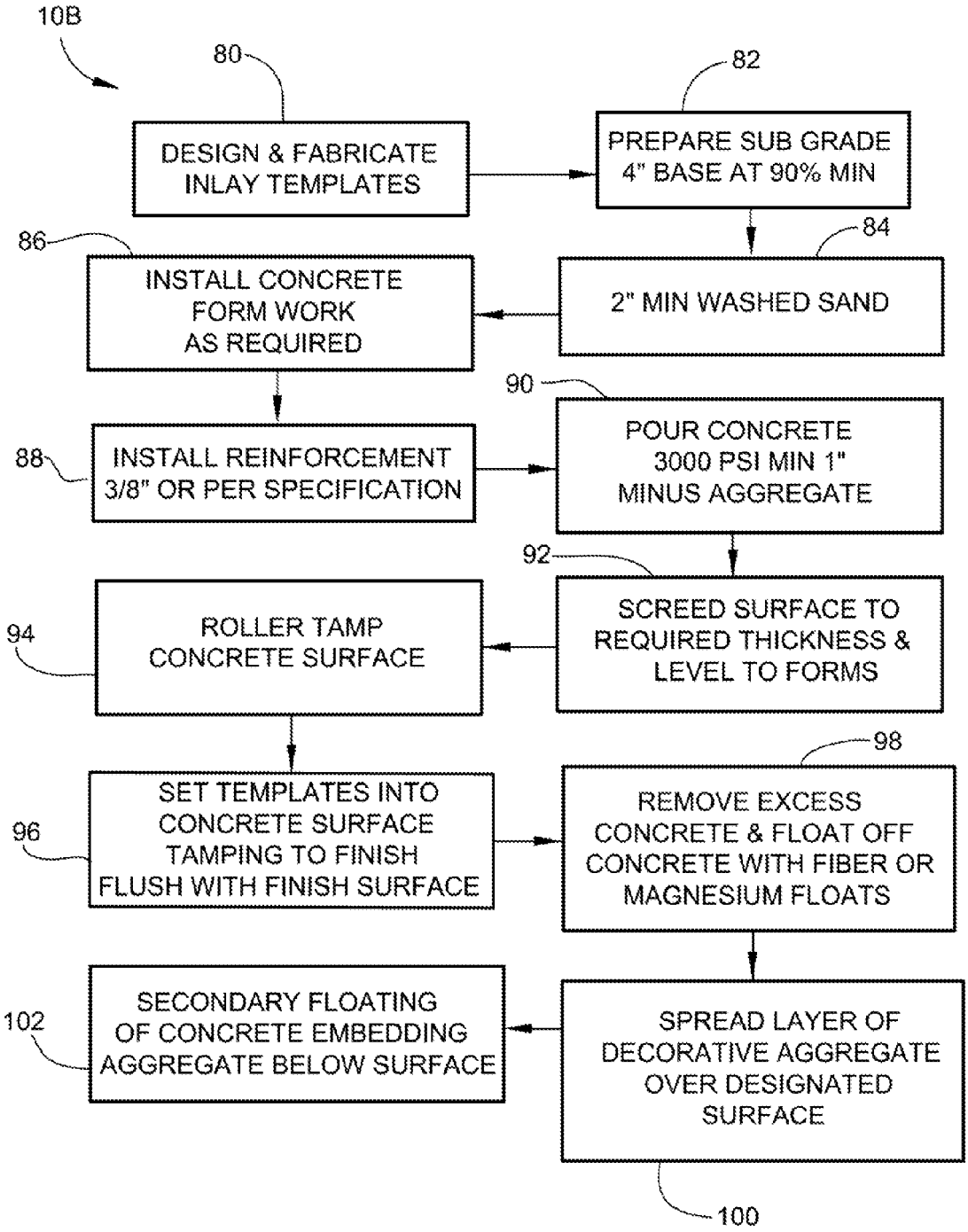
FIG. 5 depicts a block diagram of the initial steps involved in the first alternate embodiment of the Concrete Decorative Inlay Process.

FIG. 5 depicts a block diagram of the initial steps involved in the first alternate embodiment of the Concrete Decorative Inlay Process where block 80 indicates to fabricate the inlay template and then to prepare subgrade with a 4" base and a 90% minimum compaction in block 82 and to add a layer of 2" minimum washed sand in block 84. Installation of the concrete form work as required is shown in block 86 and the installation of the ⅜ rebar or per specification in 88 with the pouring of the concrete having a 3000 PSI minimum 1" minus aggregate in block 90. Block 92 indicates to screed the surface to the required thickness and level to the forms then roller tamp concrete surface shown in 94 then to set the design templates into the concrete surface tamping them to the finish flush with the finish surface described in block 96. The removal of excess concrete and floating off of the concrete with a fiber or magnesium float shown in 98 is followed by block 100 showing the spreading of a layer of decorative aggregate over designated surface and the secondary floating of the concrete embedding the aggregate below the surface with block 102 describing the secondary floating of the concrete embedding the aggregate below the surface.

Figure 6:
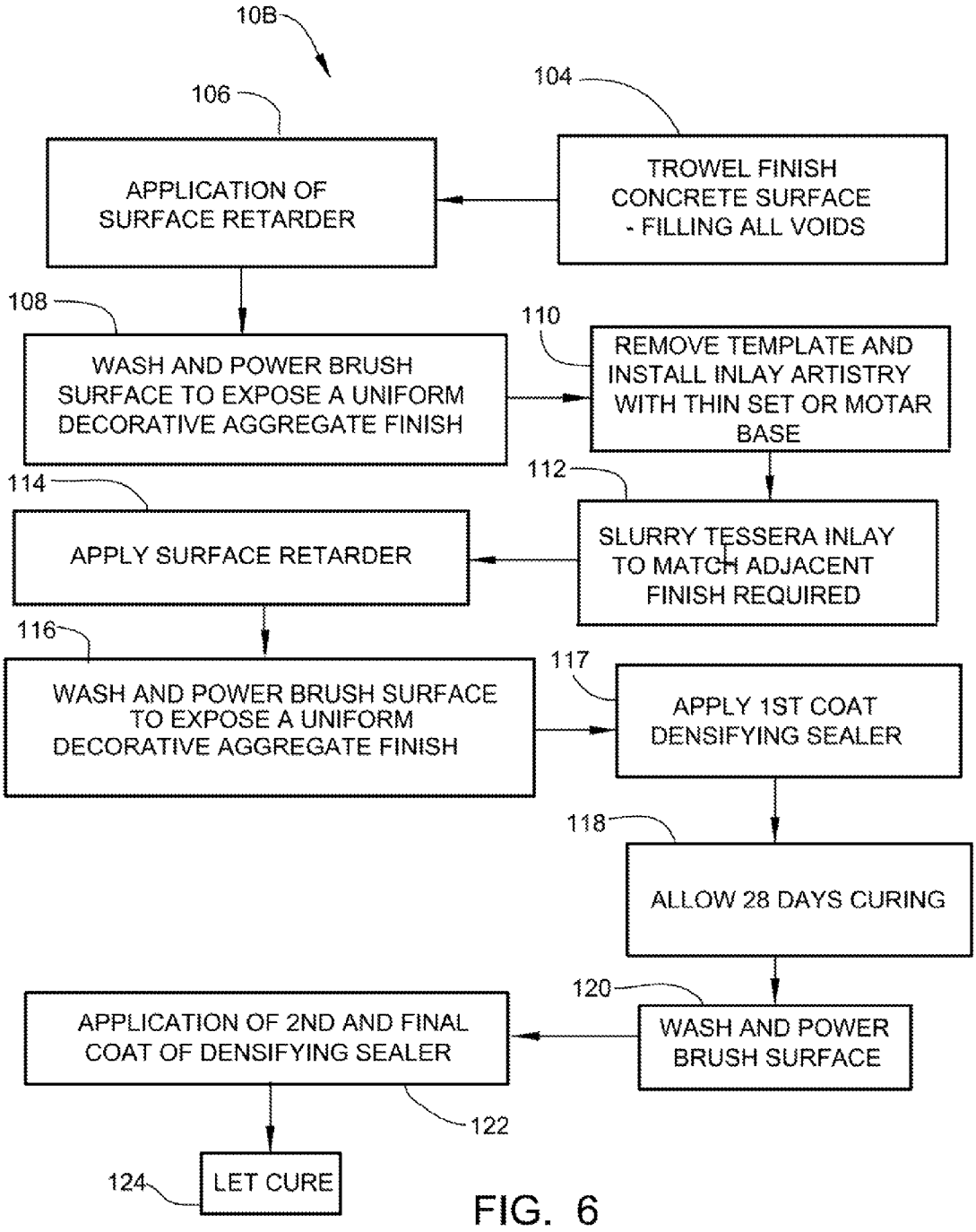
FIG. 6 depicts a second block diagram of the additional steps involved in the first alternate embodiment of the Concrete Decorative Inlay Process.

FIG. 6 depicts a second block diagram of the additional steps involved in the first alternate embodiment of the Concrete Decorative Inlay Process and describes the troweling the finish of the concrete surface filling all the voids in block 104 with the application of a surface hardener in 106 and the washing and power brushing the surface to expose a uniform decorative aggregate finish in block 108. Block 110 indicates the removal of the template and the installation of the artistry with thin set or motor base then slurry tessera inlay to match adjacent finish required in 112 and applying surface hardener in block 114. Wash and power brush the surface to expose a uniform decorative aggregate finish is shown in block 116, followed by a first application of cure and densifying sealers 117, then allowing 28 days curing time in 118 with washing and power brushing in 120. Finally the second application and final coat of sealers and densifying agents shown in block 122 then let cure in 124.

Figure 7:
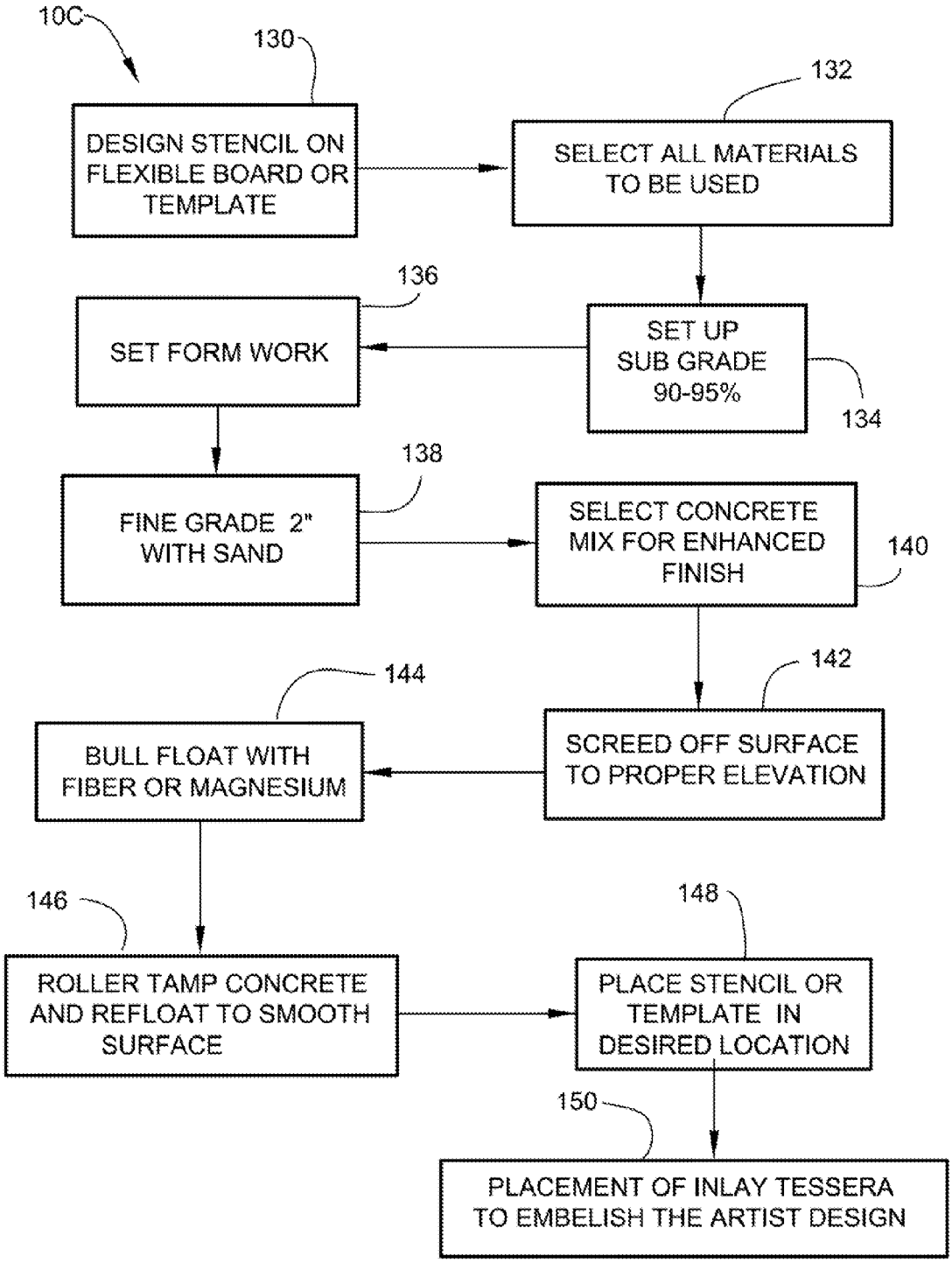
FIG. 7 depicts a block diagram of the initial steps involved in the second alternate embodiment of the Concrete Decorative Inlay Process.

FIG. 7 depicts a block diagram of the initial steps involved in the second alternate embodiment of the Concrete Decorative Inlay Process where block 130 details the design of a stencil on a flexible material and then to selection of all materials to be used in 132 then to set up the sub-grade to 90-95% compaction in 134 and the setting of the form work in block 136. Block 138 indicates the fine grading 2" using sand then selection of the concrete mix for an enhanced finish in 140 and screeding off the surface to a proper elevation in block 142. Bull floating with a fiber or magnesium float is shown in block 144 then roller tamping concrete and refloating to a smooth surface in 146 and placing the stencil in the desired location in 148 with the placement of the inlay Tessera to embellish the artistic design in block 150.

Figure 8:
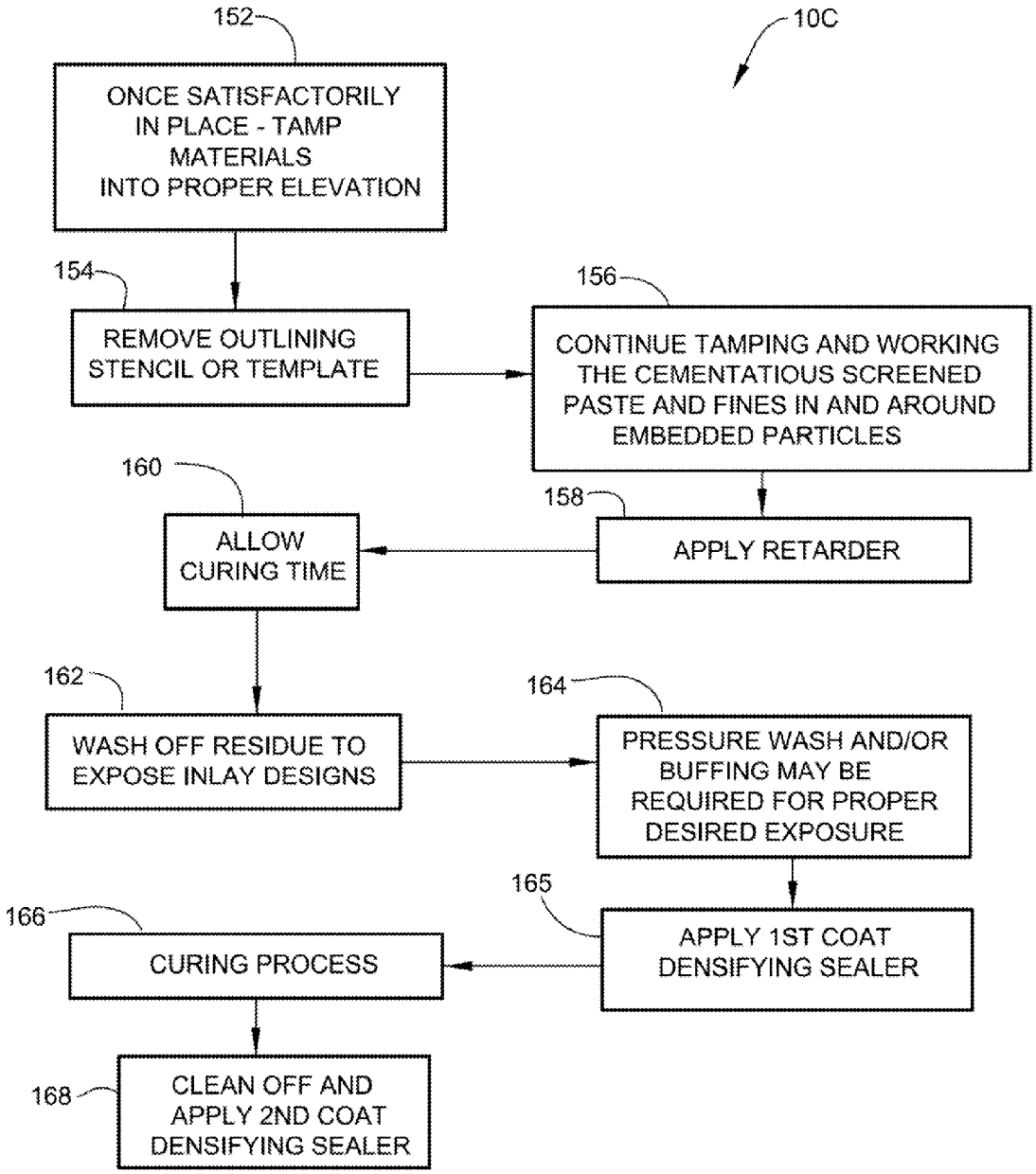
FIG. 8 depicts a second block diagram of the steps involved in the second alternate embodiment of the Concrete Decorative Inlay Process.

FIG. 8 depicts a second block diagram of the additional steps involved in the second alternate embodiment of the Concrete Decorative Inlay Process where block 152 designates once satisfactorily in place, tamp the materials into the proper elevation then the removal of the stencil in 154 and continue tamping and working the cementations paste and fines in and around embedded particles in block 156. Applying retarder is shown in 158 and allowing curing time in 160 with washing off residue to expose inlay designs in block 162. Block 164 describes the pressure washing and or buffing that may be required for the proper desired exposure. This is followed by applying the first coat of densifying sealers 165, while 166 indicates the curing process which is followed by a step to clean off and apply the second and final coat of densifying sealer 168.

Figure 9:
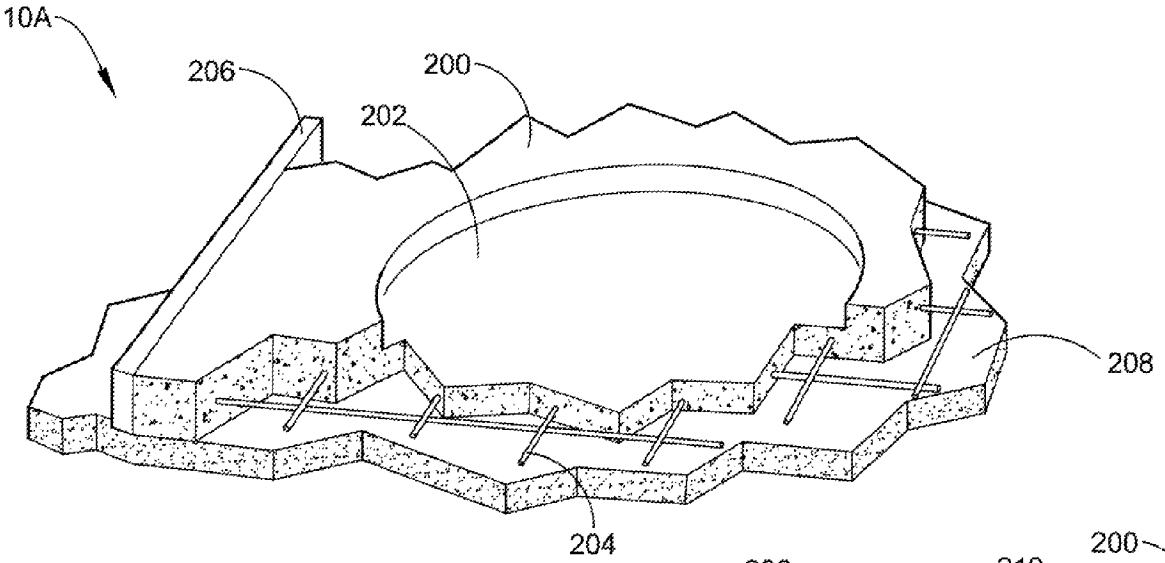
FIG. 9 depicts a perspective view of the preparation of the concrete slab with the recessed decorative area and the exposed reinforcing members.

FIG. 9 depicts a perspective view of the preparation of the concrete slab 200 with the recessed monolithic decorative area 202 and the exposed reinforcing members 204 that are within the perimeter of the form work 206. The substrate 208 is compacted to the required 90-95% compaction. A wide variety of design elements can easily be used in the surface of the concrete slab 200 including colored concrete, stampede concrete, exposed aggregate and salt finishes.

Figure 10:
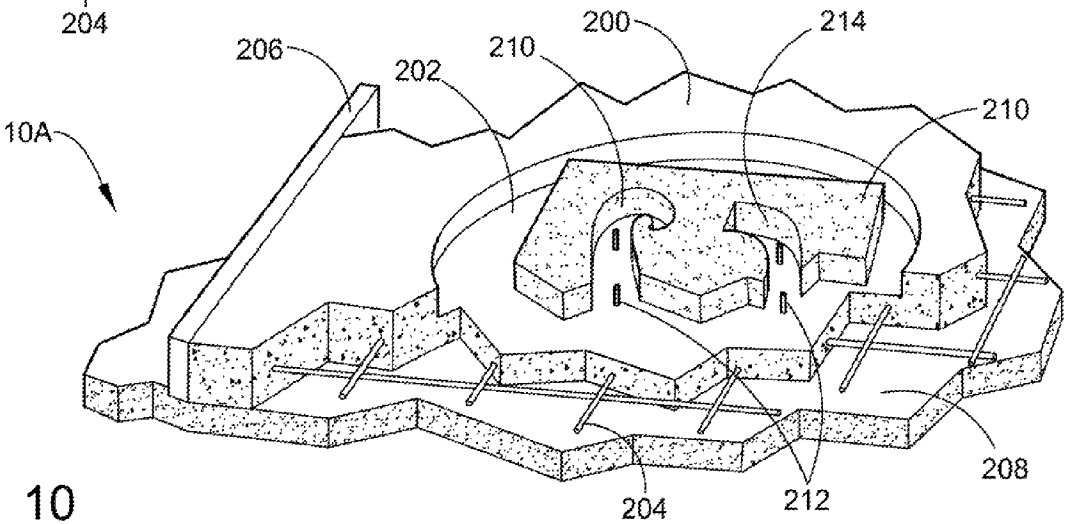
FIG. 10 depicts a perspective view of the concrete slab with the recessed decorative area with the foam template or compressed board in place with the anchor pins in the central area of the artistic design and the exposed reinforcing members.

FIG. 10 depicts a perspective view of the concrete slab 200 with the recessed monolithic decorative area 202 having the foam template or compressed board 210 in place with the anchor pins 212 in the design central area 214 of the artistic design 216 (see FIG. 11 and FIG. 12) and the exposed reinforcing members 204.

Figure 11:
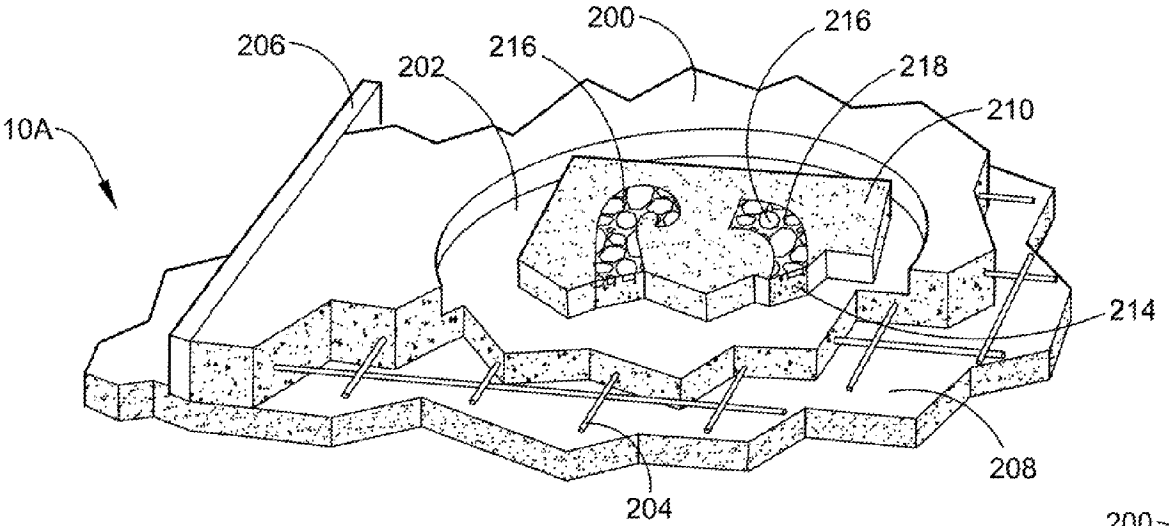
FIG. 11 depicts a perspective view of the concrete slab with the recessed decorative area with the foam template or compressed board and the inlayed design pressed into the concrete surface and the exposed reinforcing members.

FIG. 11 depicts a perspective view of the concrete slab 200 with the recessed monolithic decorative area 202 having the foam template or compressed board 210 in place and the inlayed design elements 216 pressed in the design central area 214 into the concrete design surface 218 which can be of a different color of concrete and the exposed reinforcing members 204. A wide variety of design elements 216 can easily be inlayed into the surface of the concrete to create a tessera finish 220 (see FIG. 22) such as, Vitreous glass tile, Aggregate Rock, Ceramic tile, Ammonite fossils, Glass baubles, Tumbled broken glass.

Figure 12:
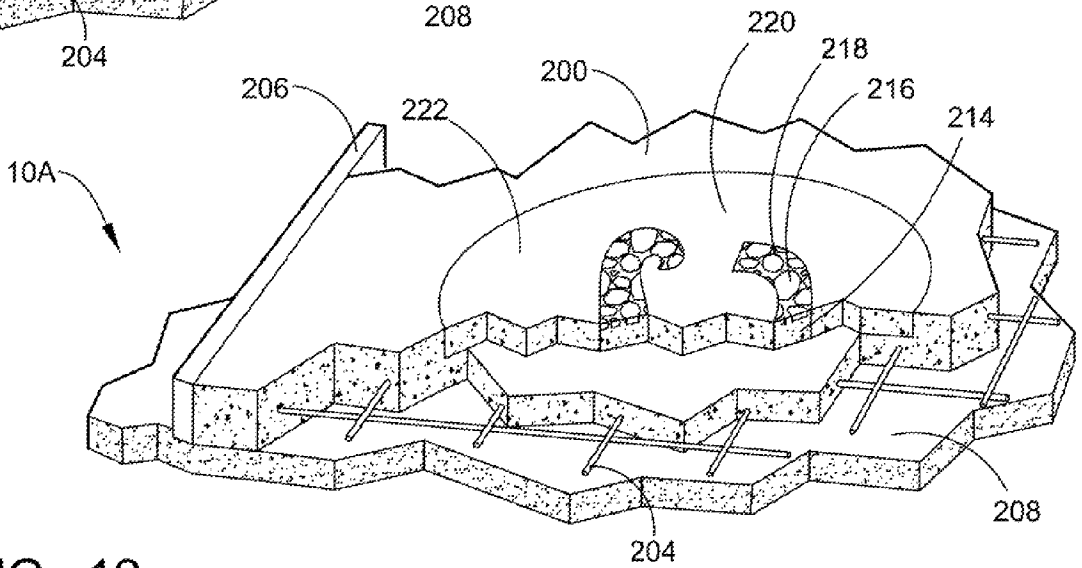
FIG. 12 depicts a perspective view of the concrete slab with the recessed decorative area and the inlayed design pressed into the concrete surface with the rest of the recessed area filled with concrete.

FIG. 12 depicts a perspective view of the concrete slab 200 with the foam template or compressed board 210 removed and the recessed decorative area 202 filled with additional variety of colored concrete 222 if desired and the inlayed design elements 216 pressed into the concrete design surface 218 exposing the reinforcing members 204.

Figure 13:
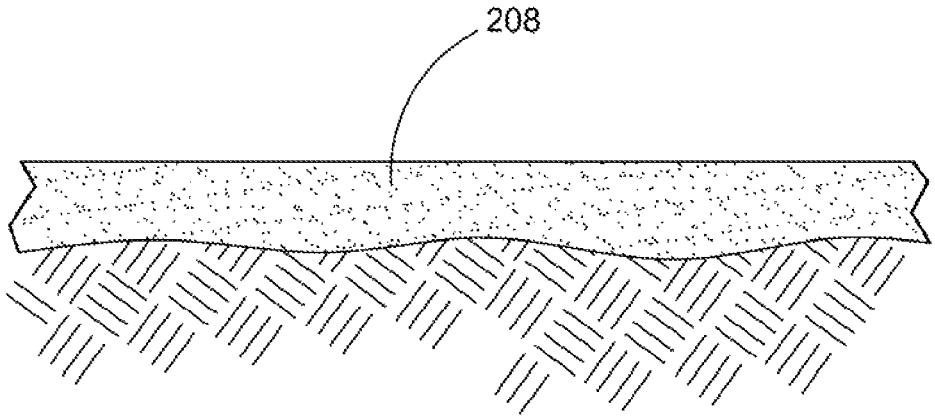
FIG. 13 depicts a side view of the preparation of the sub grade to a 90%-95% compaction.

FIG. 13 depicts a side view of the preparation of the substrate 208 to a 90%-95% compaction.

Figure 14:
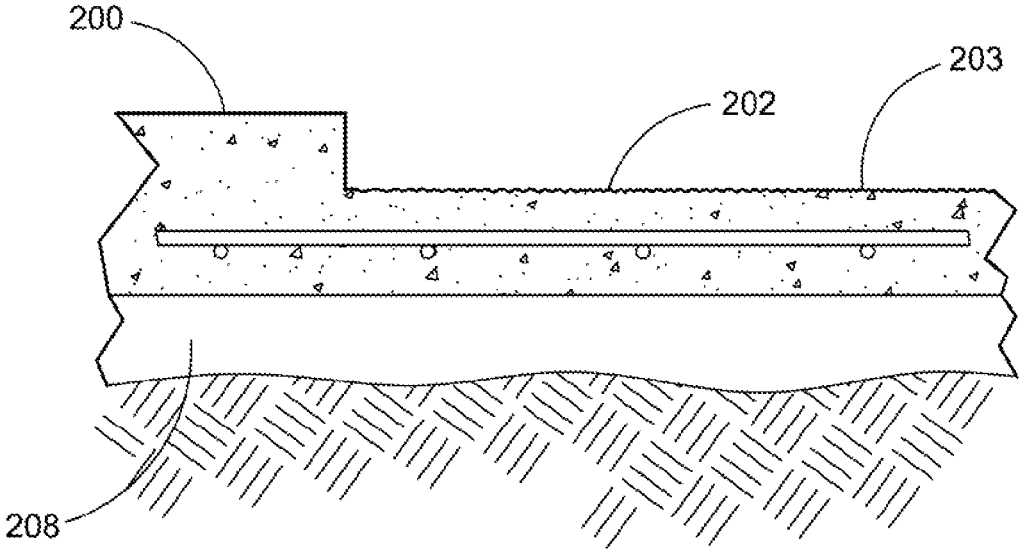
FIG. 14 depicts a side view of the recessed area in the initial pouring of the concrete slab.

FIG. 14 depicts a side view of the recessed monolithic decorative area 202 with a rough broom surface 203 in the initial poring of the concrete slab 200 above the compacted substrate 208.

Figure 15:
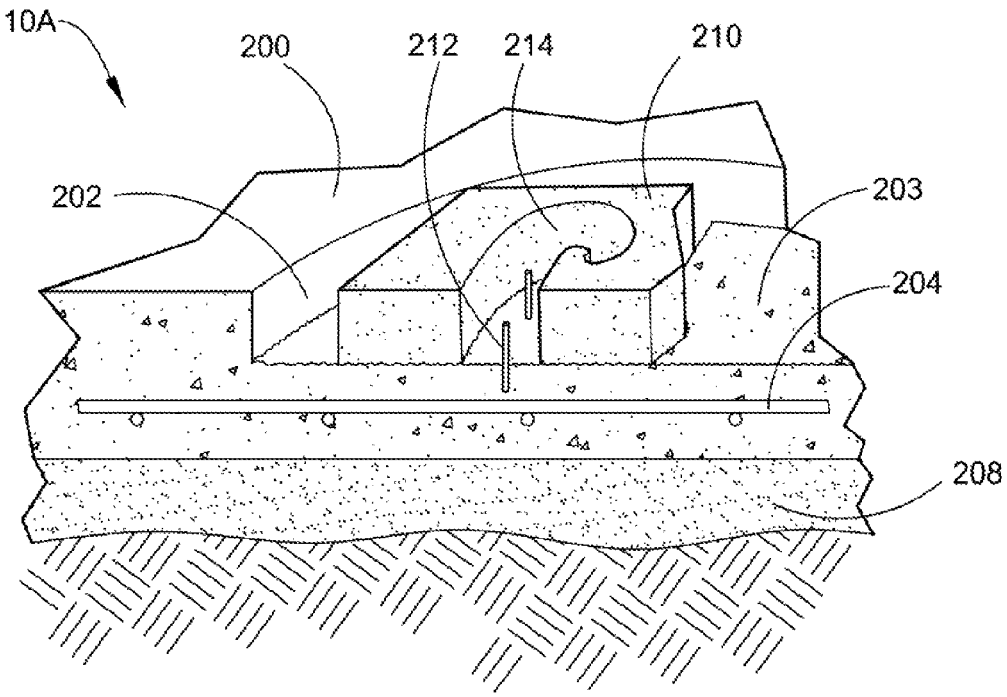
FIG. 15 depicts a perspective view of the insertion of the foam template or compressed board with the anchor pins in place.

FIG. 15 depicts a perspective view of the of the preferred embodiment 10A illustrating the concrete slab 200 with the insertion of the foam template or compressed board 210 with the anchor pins 212 in place within the design central area of the recessed monolithic decorative area 202 having a rough broom surface 203. The concrete slab 200 shows the reinforcing members 204 and is resting on the substrate 208.

Figure 16:
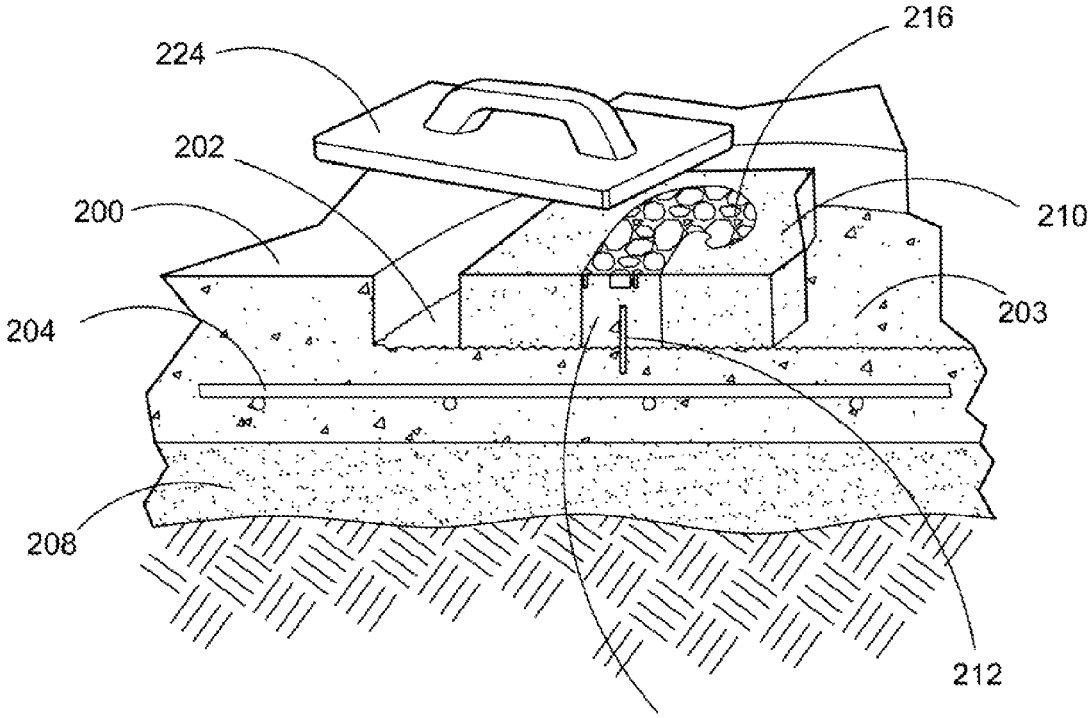
FIG. 16 depicts a perspective view of the installation of the inlayed material being smoothed with concrete float.

FIG. 16 depicts a perspective view of the installation of the inlayed design elements 216 being smoothed with a fiber or magnesium concrete float 224.

Figure 17:
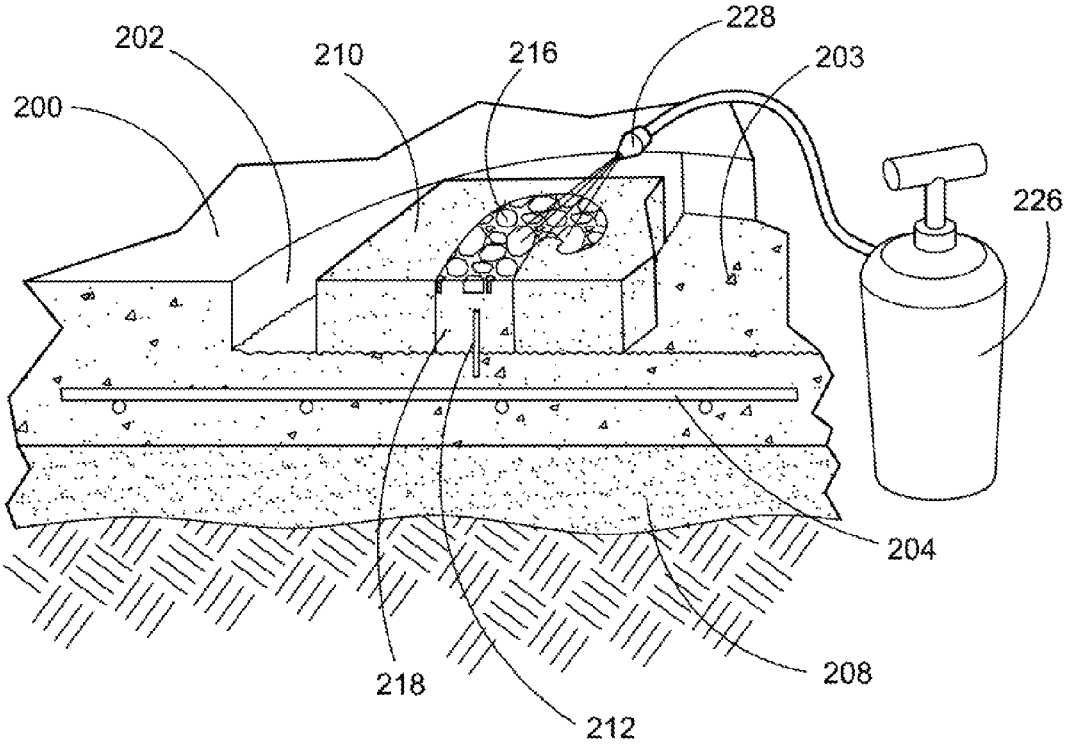
FIG. 17 depicts a perspective view of the decorative design being sprayed with the surface retarder.

FIG. 17 depicts a perspective view of the decorative design elements 216 being optionally sprayed with a spray canister 226 through a spray nozzle 228 with a surface retarder, as described in FIG. 8 step 158. This step as shown in FIG. 17 is optional.

Figure 18:
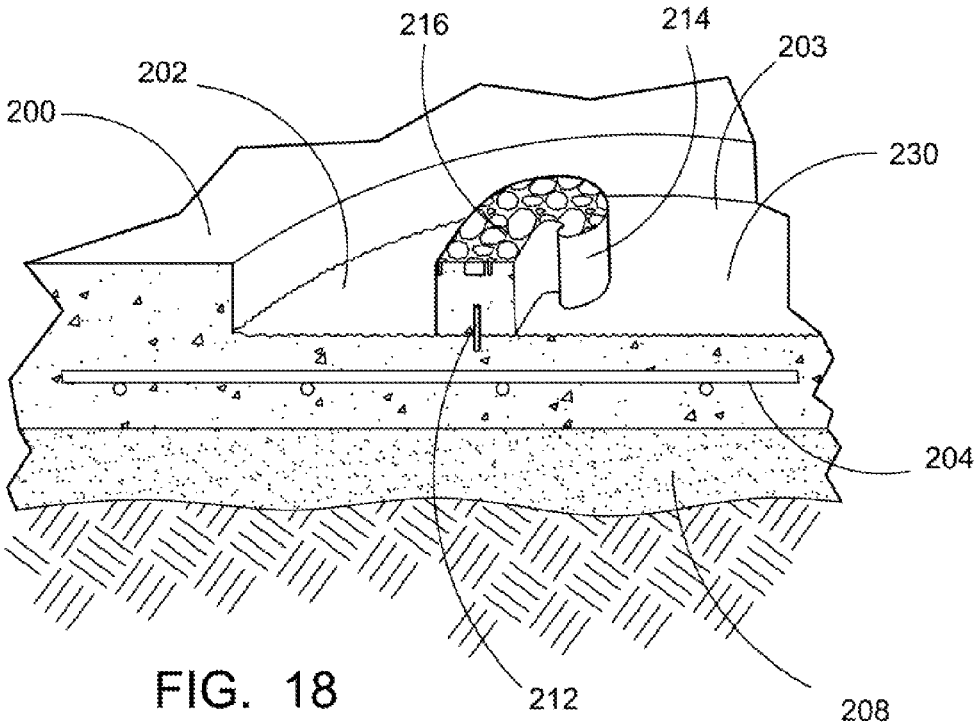
FIG. 18 depicts a perspective view if the decorative design area elevated within the recessed area.

FIG. 18 depicts a perspective view if the decorative design central area 214 elevated within the recessed monolithic decorative area 202 with a rough broom surface 203 that has been coated with a bonding agent 230.

Figure 19:
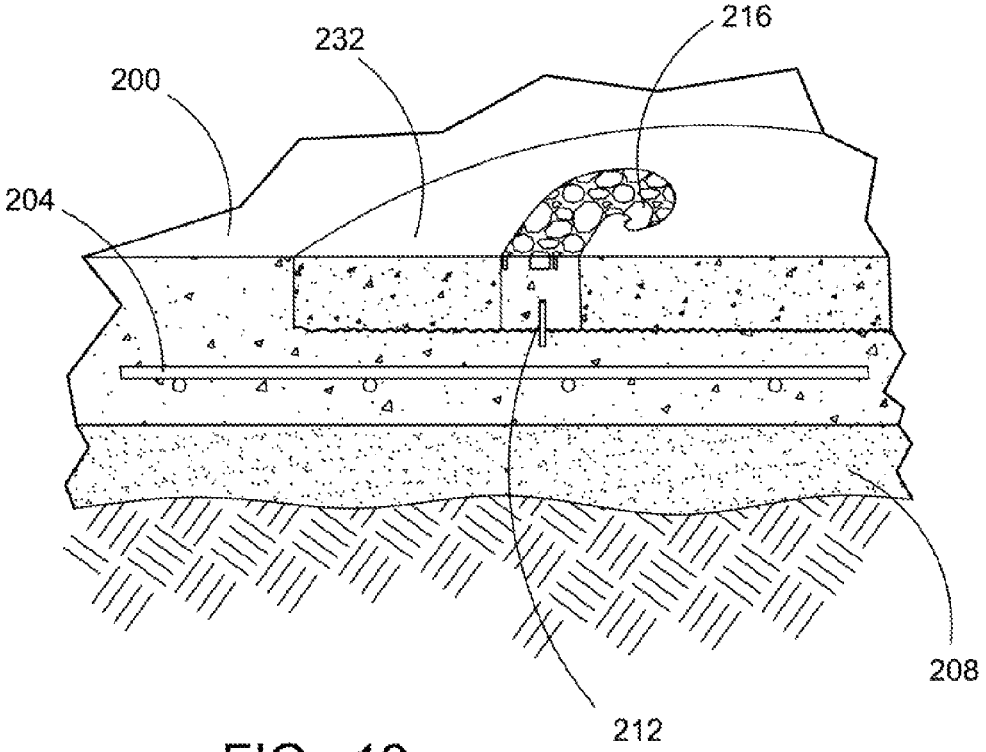
FIG. 19 depicts a perspective view of the recessed area around the decorative design filled with concrete.

FIG. 19 depicts a perspective view of the concrete filled recessed area 232 around the inlayed design elements 216 and between tessera 216 within.

Figure 20:
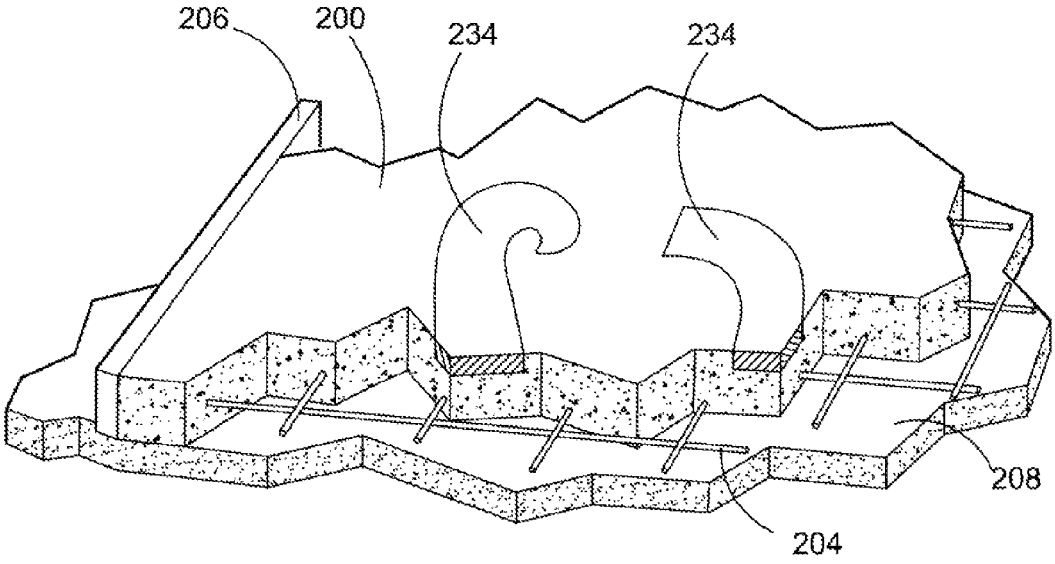
FIG. 20 depicts a perspective view of the design templates being inserted into the wet concrete.

FIG. 20 depicts a perspective view of the alternative embodiment 108 illustrating the design templates 234 constructed of wood, composition or fiberglass being inserted into the wet concrete slab 200.

Figure 21:
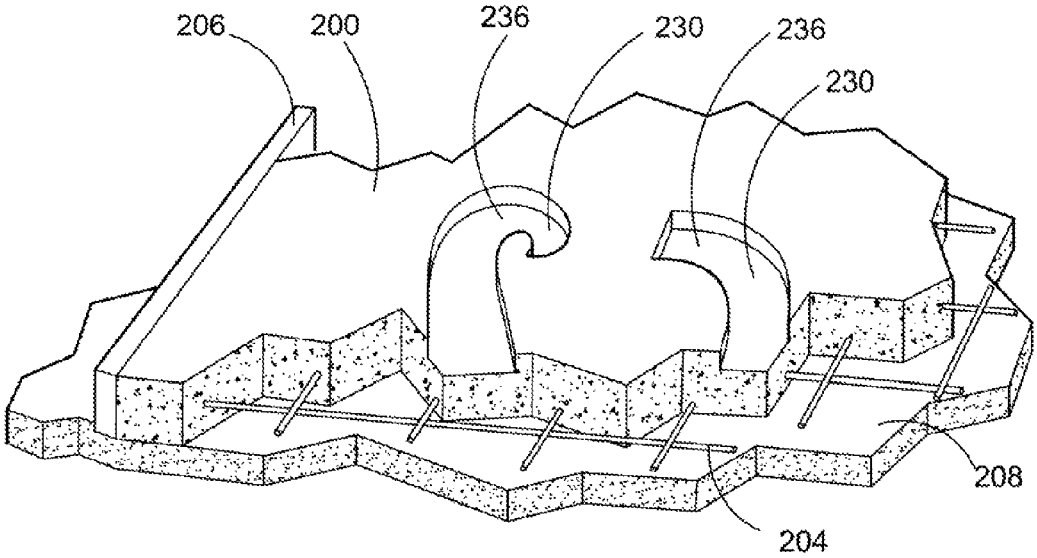
FIG. 21 depicts a perspective view of the design templates removed from the cured concrete.

FIG. 21 depicts a perspective view of the design templates 234 (as seen in FIG. 20) removed from the cured concrete slab 200 leaving recessed areas 236 that will be coated with a bonding agent 230.

Figure 22:
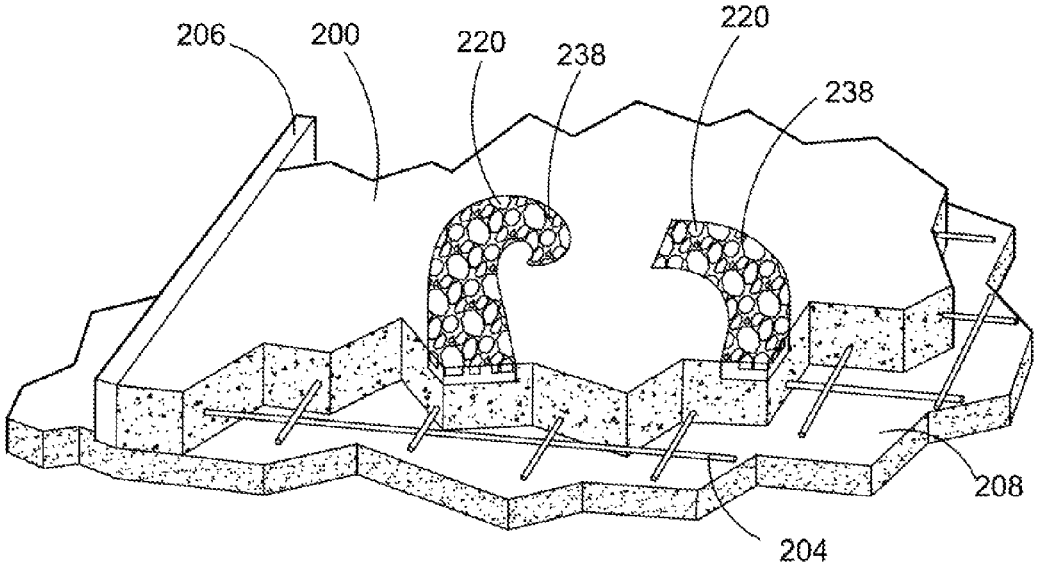
FIG. 22 depicts a perspective view of the recessed area of the design templates with the inlayed tessera material recessed in a grouting substance.

FIG. 22 depicts a perspective view of the recessed area 236 of the design templates 234 with the inlayed tessera finish 220 recessed in a grouting substance 238.

Figure 23:
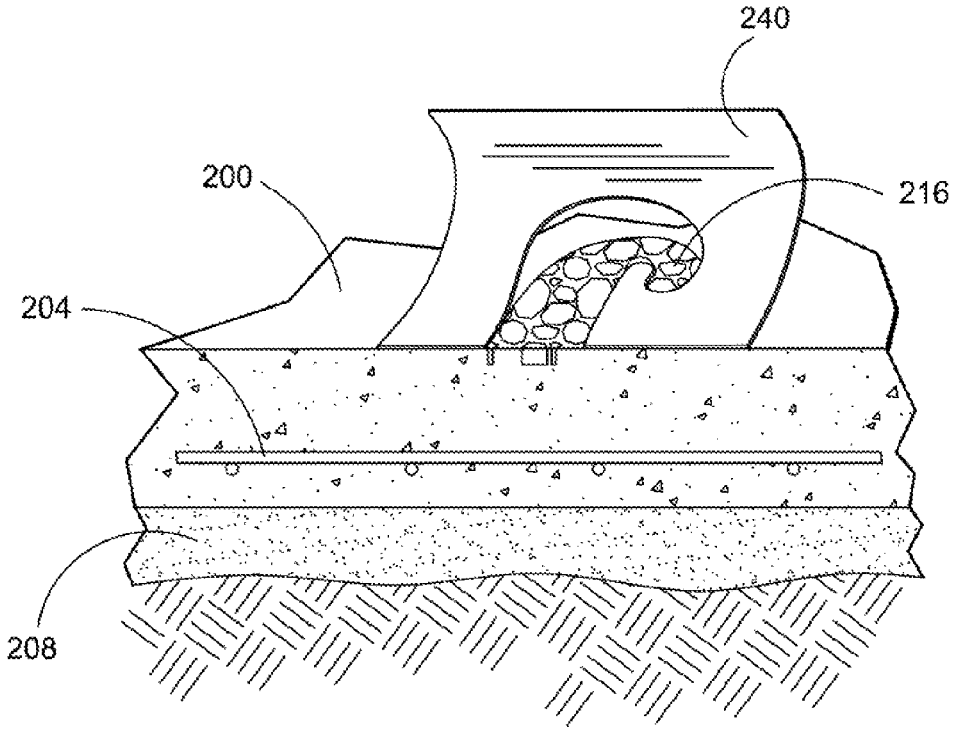
FIG. 23 depicts a perspective view of partially cured concrete with a Mylar or fiberglass template lifted up from the design of the inlayed tessera material

FIG. 23 depicts a perspective view of second alternate embodiment 10C of the partially cured concrete slab 200 with a Mylar or Fiberglas template 240 lifted up from the design of the inlayed design elements 216 of the tessera finish and inlay design elements 216.

Figure 24:
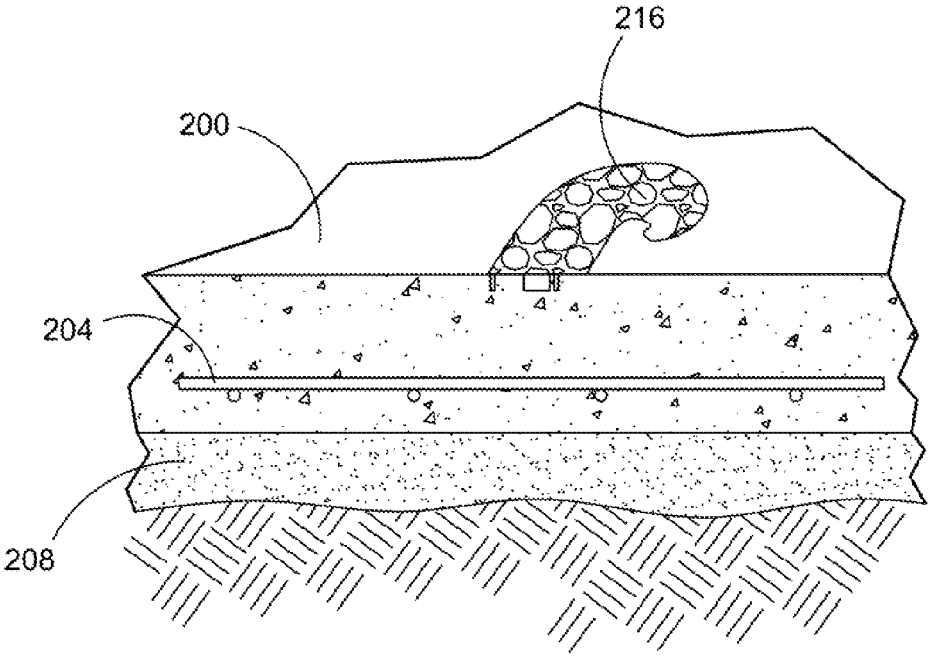
FIG. 24 depicts a finished perspective view of tessera material design in the finished concrete.

FIG. 24 depicts a finished perspective view of tessera finish and inlay design elements 216 in the finished concrete slab 200.

The Concrete Decorative Inlay Processes 10A, 10B and 10C shown in the drawings and described in detail herein disclose arrangements of elements of particular construction and configuration for illustrating preferred embodiments of structure and method of operation of the present application. It is to be understood, however, that elements of different construction and configuration and other arrangements thereof, other than those illustrated and described may be employed for providing a Concrete Decorative Inlay Processes 10A, 10B and 10C in accordance with the spirit of this disclosure, and such changes, alternations and modifications as would occur to those skilled in the art are considered to be within the scope of this design as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

We claim:

1. A concrete decorative inlay process, comprising the steps of:
   - preforming mold per artists design and preparing a sub slab with plus or minus 4 inch base materials;
   - setting form work to proper elevation and placing reinforcement bar per structural requirements;
   - pouring concrete to 3000 psi minimum with 1 inch aggregate and screed and float surface and apply heavy broom finish to recessed design area;
   - curing concrete enough to be walked on and placing artistic form within recessed location;
   - installing anchor pins to concrete slabs and applying acrylic or high mod bonding agent; and
   - placing ⅜ inch to 1 inch minus concrete mixture in design form work and proceeding with hand placement of tessera, and once in desired artistic location, tamp into finish elevation.

2. The concrete decorative inlay process according to claim 1, further comprising the steps of:
   - curing, then removing artistic form work followed by cleaning recessed design area; and
   - applying a protective barrier over inlayed design and pouring a special ⅜ inch to 1 inch minus concrete mix W/RDA and aggregate as well as non-shrinkage additive mixtures.

3. The concrete decorative inlay process according to claim 1, further comprising the steps of:
   - screeding surface to required thickness at the top of existing concrete and roller tamping concrete surface; and
   - bleeding and once bleeding is complete, fiber or magnesium float surface removing any and all lines.

4. The concrete decorative inlay process according to claim 1, further comprising the steps of:
   - spreading a layer of decorative aggregate if desired over designated surface and secondary floating with fiber/magnesium to insure maximum embedment;
   - trowel finishing allowing all cementatious paste to till in all voids in tessera and applying a top cast retarder;
   - washing and power brushing surface exposing decorative aggregate and applying first coat of densifying sealer; and
   - curing concrete for 28 days followed by a final wash and applying second and final coat of densifying sealers.

5. The concrete decorative inlay process, according to claim 1, further comprising the steps of:
   - fiber or sponge floating the fine cementatious slurry paste in circular motion and applying surface retarder; and
   - washing or power brushing surface to expose decorative design and letting cure.

6. A concrete decorative inlay process, comprising the steps of:

designing and fabricating inlay templates and prepare sub-grade 4 inch base at 90% minimum;

adding 2 inches washed sand and installing concrete form work as required;

installing reinforcement ⅜ inch or per specification and pouring concrete to 3000 psi minimum with 1 inch minus aggregate;

screeding surface to required thickness and level to forms and roller tamp concrete surface; and setting inlay templates into concrete surface and tamping to finish flush with finish surface.

7. The concrete decorative inlay process according to claim 6, further comprising the steps of:

removing excess concrete and float off concrete with fiber or magnesium floats;

spreading layer of decorative aggregate over designated surface and secondary floating of concrete embedding aggregate below surface; and trowel finishing concrete surface filling all voids and applying surface retarder and washing and power brushing surface to expose a uniform decorative aggregate finish.

8. The concrete decorative inlay process according to claim 6, further comprising the steps of:

removing template and installing inlay artistry with thin set or mortar base and slurry tessera to match adjacent finish required;

applying surface retarder and washing and power brushing surface to expose a uniform decorative aggregate finish and applying first coat of densifying sealer; and curing concrete for 28 days followed by washing and power brushing surface and applying a second coat of densifying sealer.

9. A concrete decorative inlay process, comprising the steps of:

designing an artistic design stencil on a flexible board template and selecting all inlay tessera materials to be used for the purpose of embellishing said artistic design stencil on said flexible board template;

setting up sub grade to 90-95% compaction and setting form work, then fine grade by adding 2 inches of sand;

selecting concrete mix for enhanced finish and screeding off surface to proper elevation followed by bull floating with fiber or magnesium float;

roller tamping concrete and refloating to smooth surface, then placing stencil in desired location; and placing of inlay tessera to embellish the artistic design stencil on said flexible board template, and once satisfactorily in place, tamping materials into proper elevation;

wherein said tessera materials include vitreous glass tile, aggregate rock, ceramic tile, ammonite fossils, glass baubles, and tumbled broken glass.

10. The concrete decorative inlay process according to claim 9, further comprising the steps of:

removing outlining artistic design stencil on said flexible board template and continue tamping and working the cementations screened paste and fines in and around embedded particles;

applying retarder, allowing curing time, washing off residue to expose inlay designs and pressure washing and buffing as required for proper desired exposure; and applying first coat of densifying sealer, curing, cleaning, and applying second and final coat of densifying sealer.

* * * * *